US005881643A

United States Patent [19]

Silvestre

[11] Patent Number: 5,881,643

[45] **Date of Patent: *Mar. 16, 1999**

[54] DEVICE FOR COOLING THE SURFACE OF A BLANKET OF A PRINTING UNIT CYLINDER

[75] Inventor: Alain Silvestre, Breuil le Vert, France

[73] Assignees: Heidelberger Druckmaschinen AG, Heidelberg, Germany; Heidelberg Harris SA, Montataire Cedex, France

[ * ] Notice: This patent issued on a continued prosecution application filed under 37 CFR 1.53(d), and is subject to the twenty year patent term provisions of 35 U.S.C. 154(a)(2).

[21] Appl. No.: 744,462

[22] Filed: Nov. 7, 1996

[30] Foreign Application Priority Data

Nov. 8, 1995 [FR] France ..... 95 13204

[51] Int. Cl.[6] ..... B41L 35/14; B41F 23/04

[52] U.S. Cl. ..... 101/217; 101/487

[58] Field of Search ..... 101/487, 218, 101/142, 488, 217, 177, 182; 492/46

[56] References Cited

U.S. PATENT DOCUMENTS

| | | | |
|---|---|---|---|
| 2,944,482 | 7/1960 | Aller | 101/218 |
| 3,704,669 | 12/1972 | Christoff | 101/216 |
| 4,183,298 | 1/1980 | Cappel et al. | 101/348 |
| 4,320,714 | 3/1982 | Shimazaki et al. | 101/DIG. 37 |
| 5,092,241 | 3/1992 | Feser et al. | 101/487 |
| 5,272,971 | 12/1993 | Fredericks | 101/136 |
| 5,452,657 | 9/1995 | Kurz | 101/487 |
| 5,535,674 | 7/1996 | Vrotacoe et al. | 101/487 |
| 5,571,564 | 11/1996 | Helms et al. | 101/487 |
| 5,588,360 | 12/1996 | Kurz | 101/487 |
| 5,595,115 | 1/1997 | Rau et al. | 101/487 |
| 5,607,533 | 3/1997 | Kato | 101/467 |
| 5,647,279 | 7/1997 | Johner et al. | 101/375 |

FOREIGN PATENT DOCUMENTS

| | | |
|---|---|---|
| 0 480 230 B1 | 4/1992 | European Pat. Off. . |
| 0 533 447 A2 | 3/1993 | European Pat. Off. . |
| 0 627 308 A2 | 12/1994 | European Pat. Off. . |
| 0 638 418 B1 | 2/1995 | European Pat. Off. . |
| 0 652 104 A1 | 5/1995 | European Pat. Off. . |
| 2 207 636 | 2/1989 | United Kingdom . |

*Primary Examiner*—John Hilten
*Assistant Examiner*—Leslie Grohusky
*Attorney, Agent, or Firm*—Herbert L. Lerner; Laurence A. Greenberg

[57] ABSTRACT

Dry offset printing unit having at least one plate cylinder and at least one blanket cylinder, and being equipped with a cooling circuit wherein a fluid coolant circulates, includes at least one chill roller incorporated into the cooling circuit, the at least one chill roller being bringable into contact with the surface of the at least one blanket cylinder.

12 Claims, 3 Drawing Sheets

DEVICE FOR COOLING THE SURFACE OF A BLANKET OF A PRINTING UNIT CYLINDER

BACKGROUND OF THE INVENTION

Field of the Invention

The invention relates to a device for cooling the surface of a blanket of a printing unit cylinder and, more particularly, in a dry offset printing unit of a rotary printing press which has at least one plate cylinder and at least one blanket cylinder, the printing unit being equipped with a cooling circuit wherein a fluid circulates.

Published European Patent Document EP-0,480,230 describes a thermal regulator or control for a printing plate disposed on a plate cylinder for dry offset printing. The thermal regulator is formed with a chamber for sweeping the plate with cold air, wherein fans and a refrigerating device supplied with refrigerant from a refrigerating source or plant on the outside are provided. The cooling of the refrigerant is regulated or controlled as a function of a temperature determined by the regulator or control. The construction of this heretofore known device is bulky because a coil for the refrigerant requires a path which is of such great length as to be able to cool the air.

Published European Patent Document EP-0,553,447 describes a system for cooling a printing plate of a printing press. A transverse member for blowing in cooling air is arranged lengthwise across the surface of the plate in order to keep the temperature thereof at a desired value. The transverse member houses at least one heat exchanger and at least one blower as well as at least one air reflux duct, all of which together form a cooling-air circuit. The air blown in at the surface of the plate is recycled by this circuit towards the intake side of the heat exchanger and is discharged again by the blower over the surface of the plate, possibly being mixed with fresh air after having passed through the heat exchanger. The transverse member for blowing in air represents a compact system, which does not consume very much energy, for cooling the surface of the plate. However, a drawback exists in that droplets of condensed moisture undesirably reach locations on the printing plate.

Published European Patent Document EP-0,627,308 describes a device for cooling rotary members of printing units. It has an in-blowing device including an internal circuit for recirculating the cooling air which has been deflected by the rotary member to be cooled. A cold-air generator is situated outside the in-blowing device and is connected thereto by an air inlet pipe. Energy is economized in the production of cold air, and the cold-air inlet pipes can have a relatively small cross section because a small amount of this air is all that is required. In this case too, a drawback of such a device is that droplets of condensed water may reach regions on the printing plate where they are highly undesirable and run the risk of considerably reducing the quality of the prints produced.

Published European Patent Document EP-0,638,418 describes a system for cooling cylinders of a printing press. It has at least one compressed-air inlet pipe including at least one orifice for blowing in cold air against a cylinder to be cooled. At least one recirculation circuit which is separate from the cold air arriving through the compressed-air pipe is provided, on the one hand, for sucking up the air directed through the in-blowing orifice onto the cylinder by a blower which is included in this circuit and, on the other hand, for blowing it back in onto the cylinder in parallel with the cold air. In this way, the temperature of the cold air can act upon the cylinder without a preliminary change in temperature. The cold air deflected by the cylinder is returned to the latter in order to participate in the cooling thereof.

Published European Patent Document EP-0,652,104 describes a dry offset printing unit. The dynamics of the printing unit are to be improved, and an accumulation of ink on the blanket is to be avoided. To this end, the plate cylinder supports a printing plate in the form of a sleeve, and/or the blanket cylinder supports a transfer plate in the form of a sleeve.

The printing and/or transfer plate may be slipped over the corresponding cylinder or cylinders via an opening formed in a cheek or jaw of the printing press which can be uncovered.

It should be noted that the maintenance of a given temperature is a crucial factor in dry offset printing.

Rapid fluctuations in temperature may have catastrophic consequences in dry offset printing. The heating-up which results from the operation of the printing units may be compensated for by internally cooling the compartments of the frame or the inside of the cylinders and no longer raises any problems. It has been discovered that a crucial parameter is the surface temperature of the blanket or of a sleeve forming a blanket. The work of compressing the layers of rubber causes the surface of the blanket to heat up very quickly, whereas it cools down quickly when the printing unit stops. Attempts at combating the heating-up by internally cooling the blanket cylinder with a cold-water circuit have been made. However, because the structure of the blanket has an insulating effect, the temperature of the fluid coolant has to be reduced considerably. Condensation may therefore occur on the end surfaces of the cylinder even though the blanket surface remains barely cooled.

SUMMARY OF THE INVENTION

It is accordingly an object of the invention to provide a device for cooling the surface of a blanket of a printing unit cylinder to an optimized extent so that the problem of condensation is eliminated, and rapid evacuation of heat is assured.

With the foregoing and other objects in view, there is provided, in accordance with the invention, a dry offset printing unit having at least one plate cylinder and at least one blanket cylinder, and being equipped with a cooling circuit wherein a fluid coolant circulates, comprising at least one chill roller incorporated into the cooling circuit, the at least one chill roller being bringable into contact with the surface of the at least one blanket cylinder.

In accordance with another feature of the invention, the at least one chill roller is formed with an internal cavity connected to the cooling circuit for circulating the fluid coolant therethrough.

In accordance with a further feature of the invention, the at least one chill roller has a closed outer cylindrical jacket.

In accordance with an added feature of the invention, the closed outer cylindrical jacket has a silicone coating.

In accordance with an alternative feature of the invention, the dry offset printing unit includes a sleeve mountable on the closed outer cylindrical jacket of the chill roller.

In accordance with an additional feature of the invention, the sleeve has a silicone coating.

In accordance with yet another feature of the invention, the at least one chill roller is disposed in a mechanism of the printing unit at an outlet for a printed web passing through the printing unit.

In accordance with yet a further feature of the invention, the silicone coating of the at least one chill roller or the sleeve is like a printing-plate coating.

In accordance with yet an added feature of the invention, the fluid coolant circulating in the cooling circuit is water.

In accordance with yet an additional feature of the invention, the at least one chill roller is mounted so as to be pivotable.

In accordance with still another feature of the invention, the at least one chill roller is supported by pivoting levers.

In accordance with still a further feature of the invention, the dry offset printing unit includes a positioning system for permitting the at least one chill roller to pivot.

In accordance with still an added feature of the invention, the dry offset printing unit includes adjustable stops operatively associated with the pivoting levers.

In accordance with still an additional feature of the invention, the at least one chill roller is mounted so as to be freely rotatable on the pivoting levers.

In accordance with another feature of the invention, the at least one chill roller is drivable by a gear train of the printing unit.

In accordance with a concomitant feature of the invention, the printing unit forms part of a rotary printing press.

An advantage of the construction according to the invention lies in the fact that using a cooled roller and bringing it to bear against the blanket permits the cooling to act directly at the location where a change in temperature would have detrimental effects. The contact between the cooled roller and the surface of the blanket dispenses with the in-blowing of cooling air as well as the problems of condensation of droplets which result therefrom. The droplets of condensation on freshly printed images in a rotary press with several printing units, which may otherwise cause a large part of a print run to become spoiled, are eliminated by using the device according to the invention.

In accordance with another feature of the invention, the chill roller can be mounted so that it can pivot, being supported, for example, by pivoting levers. A positioning system, for example, a pneumatic cylinder or the like, is provided for bringing the pivoting levers closer to the jacket of the blanket cylinder. Adjustable stops placed against the pivoting levers make it possible to regulate a maximum contact pressure between the surface of the chill roller and the jacket of the blanket cylinder.

In order to improve the heat transfer, the chill roller is formed with a cavity permitting heat to be evacuated directly from the interior surface of the jacket of the chill roller by the fluid coolant. The closed cylindrical jacket of the cooling member may have a silicone coating, it being possible also for a sleeve to be slipped over this jacket and to have a silicone coating on the outside thereof. This makes it appreciably easier to change the coating of the chill roller. The silicone mixture used for the coating may advantageously be the same substance as that with which the non-printing parts of a printing plate are coated.

Other features which are considered as characteristic for the invention are set forth in the appended claims.

Although the invention is illustrated and described herein as embodied in a device for cooling the surface of a blanket of a printing unit cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
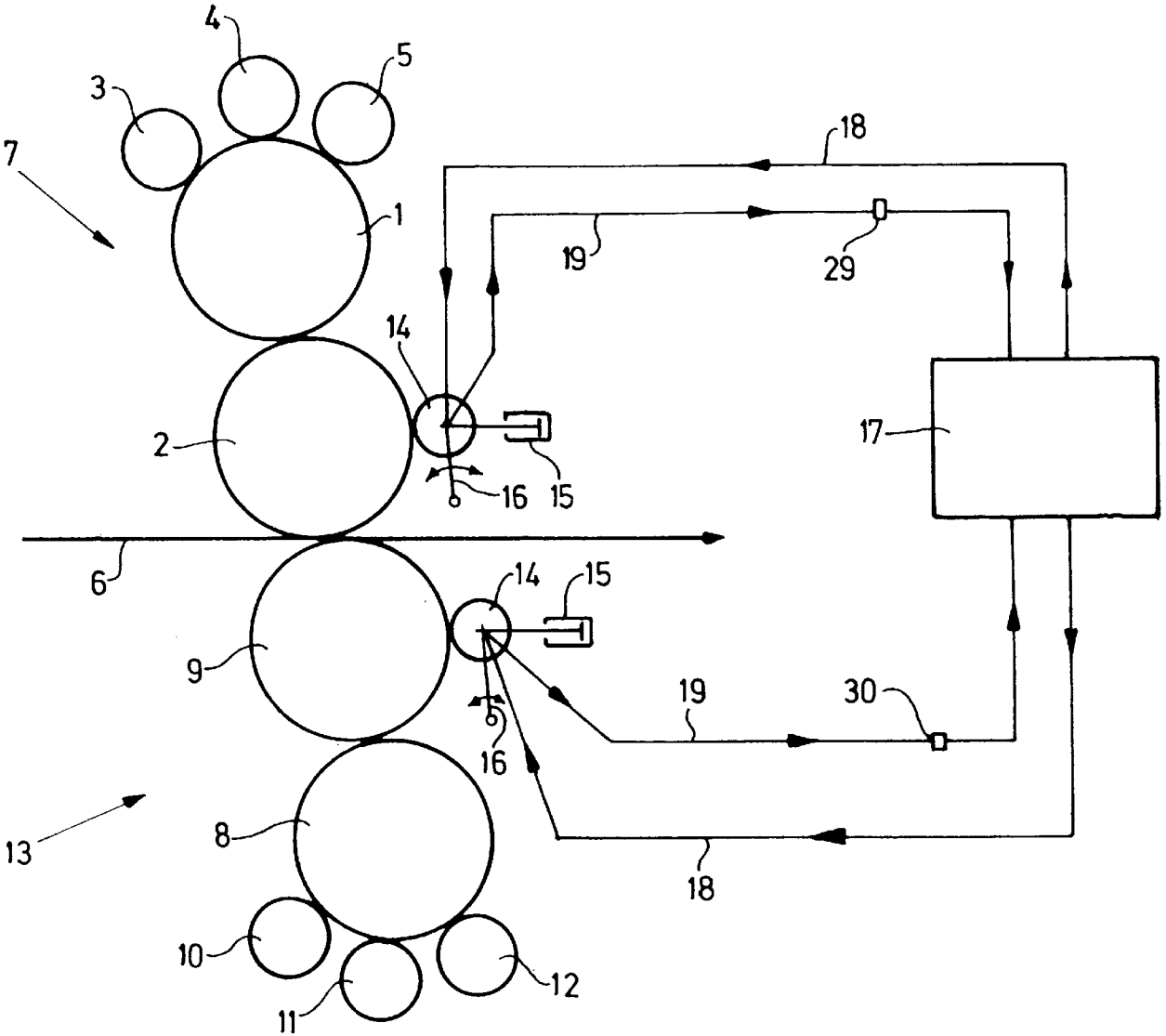
FIG. 1 is a diagrammatic and schematic view of two printing mechanisms of a printing unit, each of the printing mechanisms having a respective cooling device, which is incorporated into a cooling circuit, as well as a respective chill roller, associated therewith in accordance with the invention.

Referring now to the drawing and, first, particularly to FIG. 1 thereof, there is shown therein an upper mechanism 7 and a lower mechanism 13 of a printing unit. Three inking rollers 3, 4 and 5 lie above an upper plate cylinder 1. An image on a printing plate of the plate cylinder 1 is transferred to a blanket cylinder 2 by which it is printed on an upper face of a web 6 following a direction of travel defined by the arrow-head associated therewith. A chill roller 14 lies facing the surface of the upper blanket cylinder 2 near an outlet for the web 6. The chill roller 14 is mounted on pivoting lever 16 and is movable in the direction of the double-headed curved arrow represented in FIG. 1. The lever 16 is movable, for example, by a positioning system 15 which, in this particular embodiment, is a cylinder supplied with compressed air. The chill roller 14 is connected via a cooling circuit, which includes an inlet pipe 18 and an outlet pipe 19, to a device 17 for cooling and regulating the temperature, the device 17 being situated outside the printing unit. A sensor 29 detecting backflow temperature of the fluid coolant is provided in the outlet pipe 19 in order to control the device 17 for cooling and regulating the temperature. The sensor 29 located in the outlet pipe 19 may also be replaced by an infra-red sensor placed facing the jacket of the blanket cylinder 2 and detecting the temperature of the surface of the blanket or of the blanket sleeve of the blanket cylinder 2, this parameter being transmitted to the device 17 for cooling and regulating the temperature so as to suitably control the volumetric flow of the fluid coolant or the supply temperature thereof.

The lower printing mechanism 13 similarly includes a lower plate cylinder 8 which is inked by three corresponding rollers 10, 11 and 12. After the printing image has been transferred to the surface of a blanket cylinder 9, the latter prints the lower face of the web 6 in the direction of travel thereof. The chill roller 14 associated with the lower blanket cylinder 9 is also situated facing the surface of the blanket cylinder 9 near the outlet of the web 6. The cooling circuit provided with the inlet and outlet pipes 18 and 19 supplies the interior volume of the chill roller 14 with the fluid coolant. A sensor 30 detecting the backflow temperature of the fluid coolant is provided in the outlet pipe 19 in order to control the cooling and temperature-regulating device 17.

The chill roller 14 provided in the lower printing mechanism 13 is mounted on pivoting levers 16, and a positioning system 15 is provided for bringing it into contact or out of contact with the surface of the lower blanket cylinder 9.

A blanket or, as an alternative, a ductless blanket sleeve which performs the printing on the web 6 may be mounted just as easily on the surface of the lower blanket cylinder 9 as on the surface of the upper blanket cylinder 2.

Figure 2:
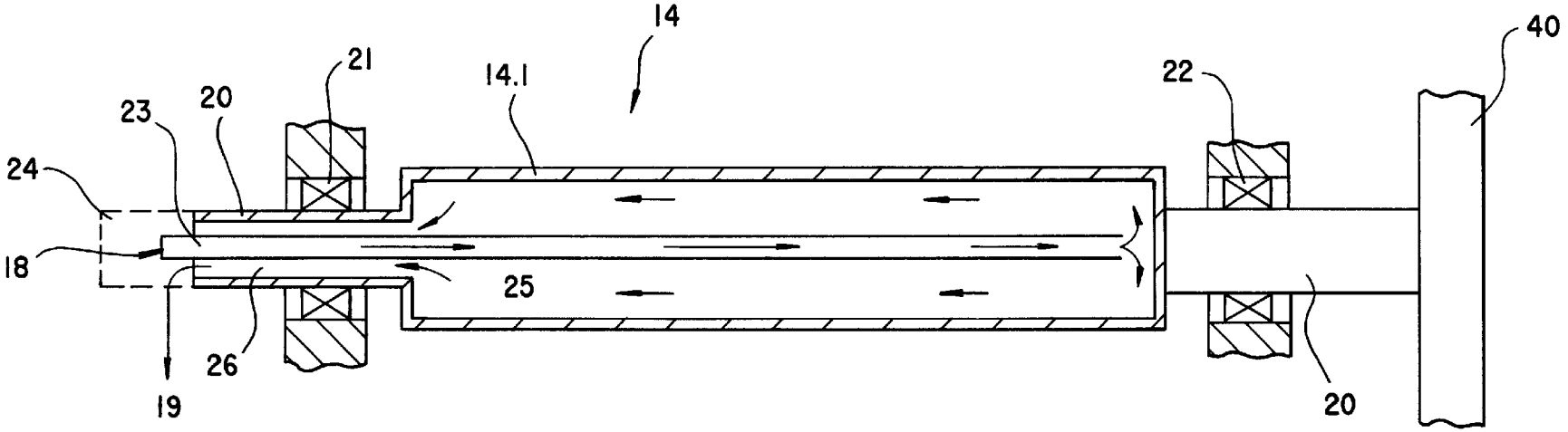
FIG. 2 is a longitudinal sectional view of one of the chill rollers according to FIG. 1.

FIG. 2 is a longitudinal sectional view of one of the chill rollers 14.

Two stub axles 20 provided at ends of the chill roller 14 are mounted, respectively, in two bearings 21 and 22. The chill roller 14 has a closed outer jacket 14.1 which delimits or defines an internal cavity 25. A hollow rod 23 connected to the inlet pipe 18 by a rotating joint 24 extends inside the internal cavity 25 along the entire length thereof. The inlet pipe 18 conveys the fluid coolant, which, in the simplest case, is water cooled in the cooling and temperature-regulating device 17, into the chill roller 14. The cooled water passes along the inside of the hollow rod 23, then circulates in a counter-flow manner through the internal cavity 25 and into a discharge pipe 26. In this way, the interior surface of the closed outer jacket 14.1 can be cooled effectively without requiring long heat-conduction processes. The heat can be evacuated directly via the outer jacket 14.1. The fluid coolant returns via the discharge pipe 26 to the outlet pipe 19, and then returns from there to the cooling and temperature-regulating device 17.

Figure 3:
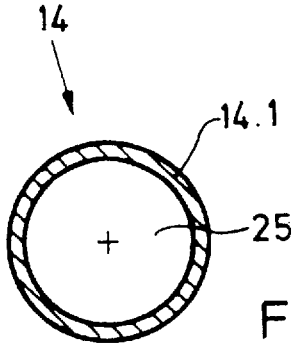
FIG. 3 is a cross-sectional view of a chill roller provided with a coating.
Figure 4:
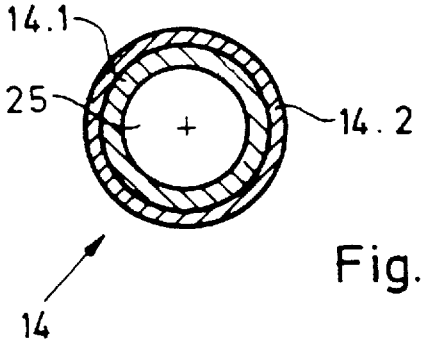
FIG. 4 is a cross-sectional view of a chill roller having a coated sleeve mounted thereon.

FIG. 3 is a cross-sectional view of the closed outer jacket 14.1 of the chill roller 14. The internal cavity 25 provided in the latter, as mentioned hereinbefore, is swept with fluid coolant. To avoid the deposition of ink at the surface of the outer jacket 14.1 of the chill roller 14, the jacket is provided with a coating for preventing ink from sticking, the coating being, for example, silicone-based such as the coating used to produce the non-printing regions on dry offset printing plates. FIG. 4 represents an alternative embodiment wherein the outer jacket 14.1 of the chill roller 14 which delimits or defines the internal cavity 25 is equipped with a closed sleeve 14.2 coated with a substance which prevents ink from sticking, as described hereinbefore. The closed sleeve 14.2 makes it easier to replace the coating at the end of a lengthy period of use. What is more, simply changing the sleeve eliminates the need for dismantling the components through which the fluid coolant passes, and thus makes it possible to reduce the intervention time considerably.

Figure 5:
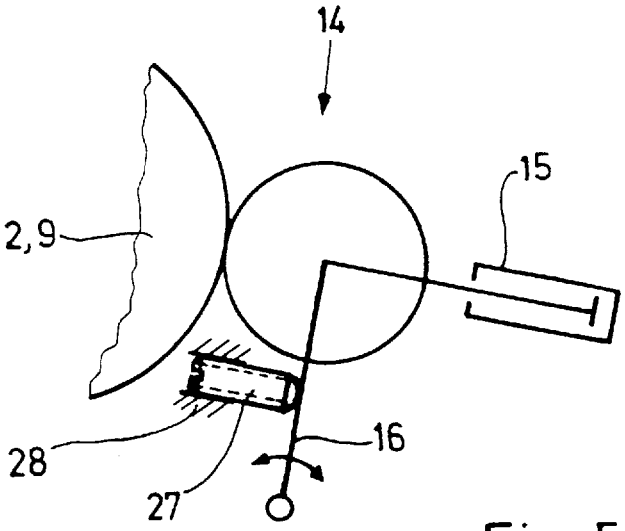
FIG. 5 is a diagrammatic view of a mechanism for controlling a pivoting movement of the chill roller.

FIG. 5 diagrammatically represents the way in which a chill roller 14 can be brought against one of the two blanket cylinders 2 and 9. Heat generated in the blanket or the blanket sleeve by the work of compression taking place on the surface during contact between the plate cylinders 1 and 8 and the blanket cylinders 2 and 9, respectively, of the printing mechanisms 7 and 13 is evacuated in the fluid coolant circulating in each chill roller 14 due to the contact thereof with the respective blanket cylinder 2, 9 and due to heat exchange. The contact pressure between the surfaces of the chill rollers 14 and the respective blanket cylinders 2 and 9 are controllable or regulatable, on the one hand, by the positioning system 15 and, on the other hand, stops 27 which are adjustable relative to the pivoting levers 16 are mounted in a support 28 so as to permit the pivoting travel of the levers 16 about the axes thereof to be limited.

In order to prevent the enlargement of a point when transferring ink from the surface of the respective blanket cylinder 2, 9 to the web 6, each chill roller 14 lies on the outlet side of the printing unit for the web 6. In this way, ink transfer is not impeded. Either each chill roller 14 is mountable so that it can rotate freely on the pivoting levers 16, which means that the respective chill roller 14 is driven at the circumferential speed of the respective blanket cylinders 2 and 9 by being pressed against the latter by the respective positioning system 15, or the chill roller 14 is drivable by the gear train 40 of the upper and lower printing mechanisms 7 and 13.

I claim:

1. In combination with a rotary printing press, a dry offset printing unit comprising:

at least one plate cylinder;

at least one blanket cylinder covered with a ductless blanket sleeve; and a cooling circuit wherein a fluid coolant circulates, said cooling circuit including at least one chill roller being bringable into contact with the surface of said at least one blanket cylinder, said at least one chill roller including a coating having a non-sticking property with respect to ink.

2. The dry offset printing unit according to claim 1, wherein said at least one chill roller is formed with an internal cavity connected to the cooling circuit for circulating the fluid coolant therethrough.

3. The dry offset printing unit according to claim 1, wherein said at least one chill roller has a closed outer cylindrical jacket disposed between a surface of said chill roller and said coating.

4. The dry offset printing unit according to claim 3, wherein said coating is a silicone coating.

5. The dry offset printing unit according to claim 3, including a sleeve mountable on said closed outer cylindrical jacket of said chill roller.

6. The dry offset printing unit according to claim 5, wherein said sleeve includes said coating, and said coating is a silicone coating.

7. The dry offset printing unit according to claim 1, wherein said at least one chill roller is disposed in a mechanism of the printing unit at an outlet for a printed web passing through the printing unit.

8. The dry offset printing unit according to claim 1, wherein said at least one chill roller is mounted so as to be pivotable.

9. The dry offset printing unit according to claim 8, including a positioning system for permitting said at least one chill roller to pivot.

10. The dry offset printing unit according to claim 8, further comprising pivoting levers supporting said at least one chill roller.

11. The dry offset printing unit according to claim 10, including adjustable stops operatively associated with said pivoting levers.

12. The dry offset printing unit according to claim 10, wherein said at least one chill roller is drivable by a gear train of the printing unit.

* * * * *